US010330428B2

(12) United States Patent
Kindig et al.

(10) Patent No.: US 10,330,428 B2
(45) Date of Patent: Jun. 25, 2019

(54) COMBINATION CROSSBOW STIRRUP AND SHOOTING REST MECHANISM

(71) Applicant: Hunter's Manufacturing Company, Inc., Suffield, OH (US)

(72) Inventors: Michael A. Kindig, Aurora, OH (US); Michael J. Shaffer, Mogadore, OH (US); Richard L. Bednar, Munroe Falls, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/903,476

(22) Filed: Feb. 23, 2018

(65) Prior Publication Data

US 2018/0238656 A1 Aug. 23, 2018

Related U.S. Application Data

(60) Provisional application No. 62/462,589, filed on Feb. 23, 2017.

(51) Int. Cl.

| | |
|---|---|
| ***F41B 5/12*** | (2006.01) |
| ***F41B 5/14*** | (2006.01) |
| ***F41A 23/08*** | (2006.01) |
| *F41A 23/16* | (2006.01) |

(52) U.S. Cl.

CPC ..... *F41B 5/1469* (2013.01); *F41A 23/08* (2013.01); *F41B 5/12* (2013.01); *F41B 5/123* (2013.01); *F41A 23/16* (2013.01)

(58) Field of Classification Search

CPC ..... F41B 5/12

See application file for complete search history.

(56) References Cited

U.S. PATENT DOCUMENTS

| | | | | |
|---|---|---|---|---|
| 3,256,872 | A * | 6/1966 | Koser | F41B 5/14 124/23.1 |
| 6,032,911 | A * | 3/2000 | Osborne | F41A 23/18 248/229.15 |
| 7,380,486 | B1 | 6/2008 | Bean | |
| 7,500,328 | B1 | 3/2009 | Bean | |
| 7,624,725 | B1 | 12/2009 | Choma | |
| 7,677,233 | B2 | 3/2010 | Bednar | |
| 8,161,956 | B2 | 4/2012 | Bednar | |
| 8,434,463 | B2 | 5/2013 | Bednar | |
| 8,944,038 | B2 | 2/2015 | Bednar et al. | |
| 9,303,945 | B1 * | 4/2016 | Hughes | F41G 11/003 |
| 9,310,153 | B2 * | 4/2016 | Nettleton | F41A 23/10 |
| 2014/0283805 | A1 * | 9/2014 | Dunlop | F41B 5/12 124/25 |

OTHER PUBLICATIONS

Killer Instinct, Owners Instruction Manual.

* cited by examiner

*Primary Examiner* — John A Ricci

(74) *Attorney, Agent, or Firm* — Emerson Thomson Bennett, LLC

(57) ABSTRACT

A bracket may be adjustable with respect to a bracket engagement device and serve as both a stirrup and a shooting rest for a crossbow. One or more biasing force generators may be used to bias the bracket into one of at least two relative positions with respect to the bracket engagement device.

20 Claims, 6 Drawing Sheets

COMBINATION CROSSBOW STIRRUP AND SHOOTING REST MECHANISM

This application claims priority to U.S. Ser. No. 62/462,589, titled FOLDING STIRRUP AND REST FOR A CROSSBOW, filed Feb. 23, 2017, which is incorporated herein by reference.

I. BACKGROUND

A. Field of the Invention

This invention generally relates to methods and apparatuses related to crossbows and more specifically to methods and apparatuses related to crossbow stirrups and shooting rests.

B. Description of Related Art

Crossbows have been used for many years as a weapon for hunting and fishing, and for target shooting. In general, a crossbow includes a main beam that may have a stock member and a barrel connected to the stock member. The barrel typically has an arrow receiving area for receiving the arrow that is to be fired or shot. The crossbow also includes a bow assembly supported on the main beam that includes a bow (including a pair of bow limbs) and a bowstring connected to the bow for use in shooting arrows. A trigger mechanism, also supported on the main beam, holds the bowstring in a drawn or cocked condition and can thereafter be operated to release the bowstring to an uncocked condition to fire or shoot the arrow.

To adjust a crossbow into the cocked condition, it is known to provide a stirrup. Stirrups generally are supported to the main beam, sometimes through a riser, and extend away from the main beam in the direction that the arrow is shot. Stirrups include a contact surface that is positioned on the ground (or other cocking support surface) and a contact surface upon which the user places his/her foot while pulling the bowstring away from the bow until the bowstring engages the trigger mechanism, thereby cocking the crossbow. While known stirrups generally work well for their intended purpose, a known problem with stirrups is that they are fixed to the main beam—adding length to the crossbow and making the crossbow more cumbersome to use and carry. While folding stirrups are known, they do not provide a positive lock for specific positions and are limited to use as a stirrup. Another problem with stirrups is that they add weight to the crossbow.

In order to provide more accurate shooting of a crossbow, it is known to provide a crossbow with a shooting rest. A shooting rest includes a contact surface that is positioned on the ground (or other shooting support surface) to support the crossbow while it is shot. Numerous types of shooting rests are known, including monopod, bipod and tripod designs. While known rests generally work well for their intended purpose, they are known to have problems. One problem is that shooting rests often require that the main beam have a special design, such as a picatinny rail or a weaver rail, to which the shooting rest is attached for use. Another problem is that known shooting rests are limited to use as a shooting rest. Yet another problem with shooting rests, as with stirrups, is that they add weight to the crossbow.

What is needed is a single device that operates as both a stirrup and a shooting rest. This device may be easily adjusted into a number of predetermined positions relative to the main beam. This combined stirrup and shooting rest mitigates the problems noted above, and others, as will be readily understood by a person of skill in the art.

II. SUMMARY

According to some embodiments of this invention, a combination crossbow stirrup and shooting rest mechanism may be used with an associated crossbow having a main beam and a bow assembly supported to the main beam. The combination crossbow stirrup and shooting rest mechanism may comprise: a bracket having a connection surface and first and second contact surfaces; a bracket engagement device that is supportable to the main beam and that comprises first and second distinct connection surfaces; and one or more biasing force generators. When the bracket engagement device is supported to the associated crossbow, the bracket may be rotatable with respect to the bracket engagement device between: 1) a cocking position where the connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; and 2) a shooting rest position where the connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface. The one or more biasing force generators may exert: 1) a biasing force to bias the bracket into the cocking position and; 2) a biasing force to bias the bracket into the shooting rest position.

According to other embodiments of this invention, a method for using a combination crossbow stirrup and shooting rest mechanism with an associated crossbow having a main beam and a bow assembly supported to the main beam may include the steps of: A) providing a combination crossbow stirrup and shooting rest mechanism comprising: a bracket having a connection surface and first and second distinct contact surfaces; a bracket engagement device that is supportable to the main beam and that comprises first and second distinct connection surfaces; and one or more biasing force generators; B) providing the combination crossbow stirrup and shooting rest mechanism to be operable to perform the following steps when the bracket engagement device is supported to the associated crossbow: 1) manually rotating the bracket with respect to the bracket engagement device into a cocking position where the connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; 2) automatically applying a biasing force from the one or more biasing force generators to bias the bracket into the cocking position; 3) manually overcoming the biasing force that biases the bracket into the cocking position; 4) manually rotating the bracket with respect to the bracket engagement device into a shooting rest position where the connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface; and 5) automatically applying a biasing force from the one or more biasing force generators to bias the bracket into the shooting rest position.

According to yet other embodiments of this invention, an apparatus may be used with an associated crossbow having a main beam and a bow assembly. The apparatus may comprise: a riser that: is supportable to the main beam; is designed to support bow limbs; and comprises first, second and third distinct connection surfaces; and a bracket having a connection surface and first and second distinct contact surfaces. When the riser is supported to the associated crossbow: A) the bracket may be rotatable with respect to the riser between: 1) a cocking position where the connection surface of the bracket is interconnected with the first connection surface of the riser and the bracket is positioned to enable a user to use the bracket as a stirrup to cock the associated bow assembly with the first contact surface receiving the user's foot and the second contact surface contacting a ground or other cocking support surface; 2) a shooting rest position where the connection surface of the bracket is interconnected with the second connection surface of the riser and the bracket is positioned to enable a user to use the bracket as a shooting rest to shoot the associated crossbow with the second contact surface contacting a ground or other shooting support surface; and 3) a carry position where the connection surface of the bracket is interconnected with the third connection surface of the riser and the bracket is positioned to enable a user to carry the associated crossbow with reduced bracket interference. The bracket may rotate at least 70 degrees with respect to the riser about an axis of rotation between the cocking position and the shooting rest position. The bracket may rotate at least 70 degrees with respect to the riser about the axis of rotation between the shooting rest position and the carry position. The bracket may rotate at least 140 degrees with respect to the riser about the axis of rotation between the cocking position and the carry position.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DEFINITIONS

The following definitions are controlling for the disclosed inventions:

"Arrow" means a projectile that is shot with (or fired by or launched by) a bow assembly.

"Bow" means a bent, curved, or arched object. A bow includes a pair of bow limbs.

"Bow Assembly" means a weapon comprising a bow and a bowstring that shoots (or fires or propels) arrows powered by the elasticity of the bow and the drawn bowstring.

"Bowstring" means a string or cable attached to a bow and used to shoot (or fire or propel) arrows.

"Compound Bow" means a bow that has wheels, pulleys or cams at each end of the bow through which the bowstring passes. A compound bow may include strings or cables in addition to the bowstring that interconnect the wheels, pulleys or cams to each other and/or to other portions of the bow.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. A main beam may include a stock member and a barrel. Sometimes a barrel is a distinct component from the stock member that is attached to the stock member. Other times the barrel and stock member comprise a single component.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

V. DETAILED DESCRIPTION

Figure 1:
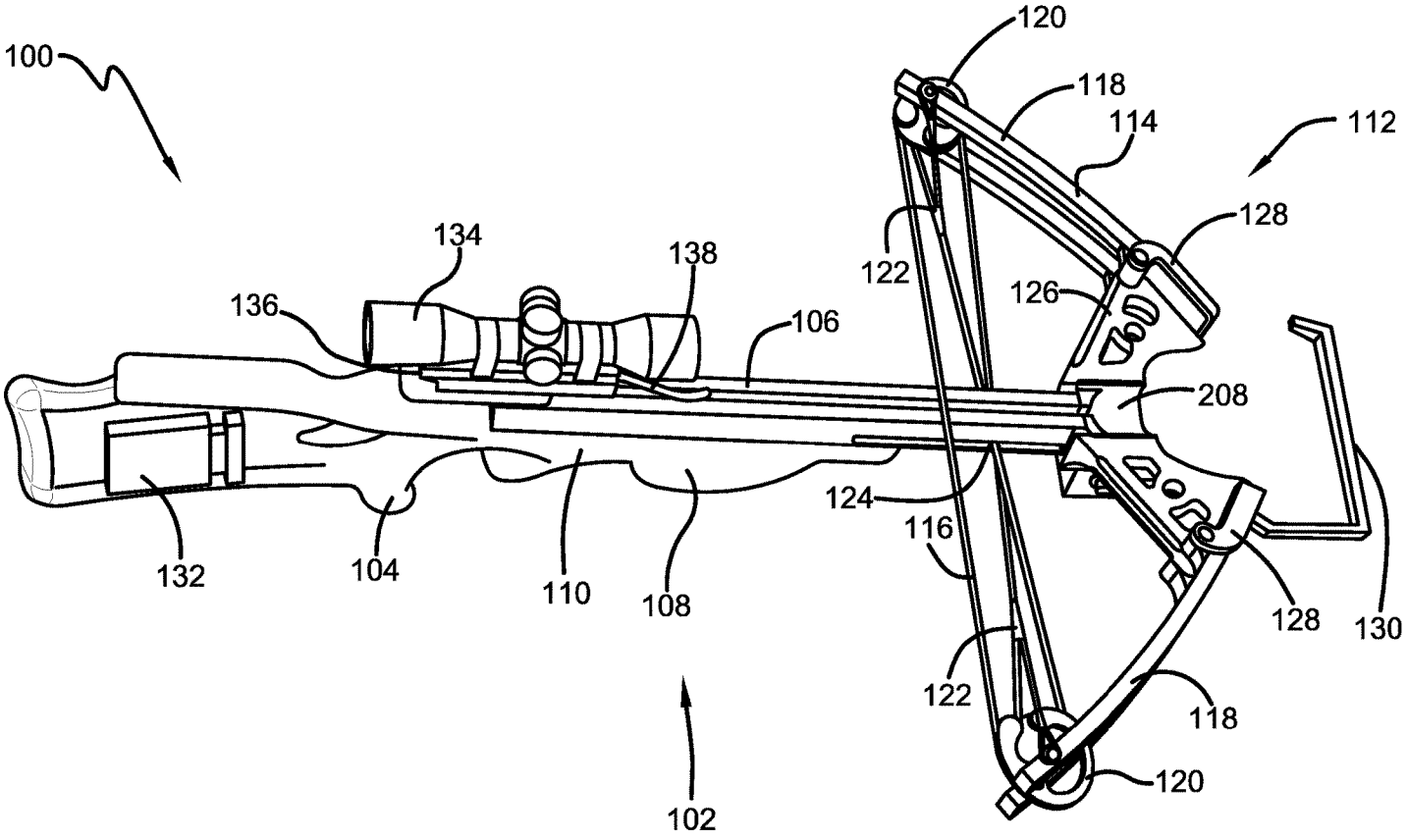
FIG. 1 is a perspective view a crossbow.

Referring now to the drawings wherein the showings are for purposes of illustrating embodiments of the invention only and not for purposes of limiting the same, and wherein like reference numerals are understood to refer to like components, FIG. 1 shows a crossbow 100 that may use a combination crossbow stirrup and shooting rest mechanism 130 according to some embodiments of this invention. The crossbow 100 may have a main beam 102 including a stock member 104 and a barrel 106. An optional handgrip 108 may be mounted to the main beam 102 in any conventional manner. A trigger mechanism 110 suitable for shooting an arrow is mounted to the main beam 102 in any suitable manner. It should be noted that the crossbow 100 may comprise any trigger mechanism 110 chosen with sound judgment by a person of ordinary skill in the art. The crossbow 100 also includes a bow assembly 112 adapted to propel an arrow and having a bow 114 and a bowstring 116. The bow 114 includes a pair of bow limbs 118, 118 that receive the bowstring 116 in any conventional manner chosen with the sound judgment of a person of ordinary skill in the art. For the embodiment shown, a pair of cams (which may be also pulleys and/or wheels) 120, 120 mounted to the bow limbs 118, 118 receive the bowstring 116 in a known manner; making the bow a compound bow. While the crossbow shown uses a compound bow, it should be understood that this invention will work well with any type of bow chosen with sound judgment by a person of ordinary skill in the art. One or more strings or cables 122, in addition to the bowstring 116, may be interconnected between the wheels 120 and the crossbow 100 in any manner chosen with the sound judgment of a person of skill in the art. The one or more cables 122 may pass through a barrel slot 124 formed in the barrel 106, as shown.

With continuing reference to FIG. 1, numerous other crossbow components may be used, or not used, with a crossbow using a combination crossbow stirrup and shooting rest mechanism 130 according to some embodiments of this invention. The crossbow 100 may include, for example, a riser or block 126 that is supported to the main beam 102 and that has a pair of limb pockets 128, 128 that support the bow limbs 118, 118, as shown. The combination crossbow stirrup and shooting rest mechanism 130 of this invention may be attached to the riser 126 and may be used as will be discussed below. In alternate embodiments, the combination crossbow stirrup and shooting rest mechanism 130 may be attached directly to the main beam 102 without the use of a riser. In still other embodiments, a riser may work with a bracket as will be discussed below. An optional cocking unit 132 may be provided for use in cocking the crossbow 100 when the stirrup is not used. Still other optional components may include a scope 50 attached to a scope mount 52 that is supported to the main beam 102. Another optional component shown is an arrow retention spring 138. As the operation of these components is well known to those of skill in the art, no further details will be provided.

Figure 2:
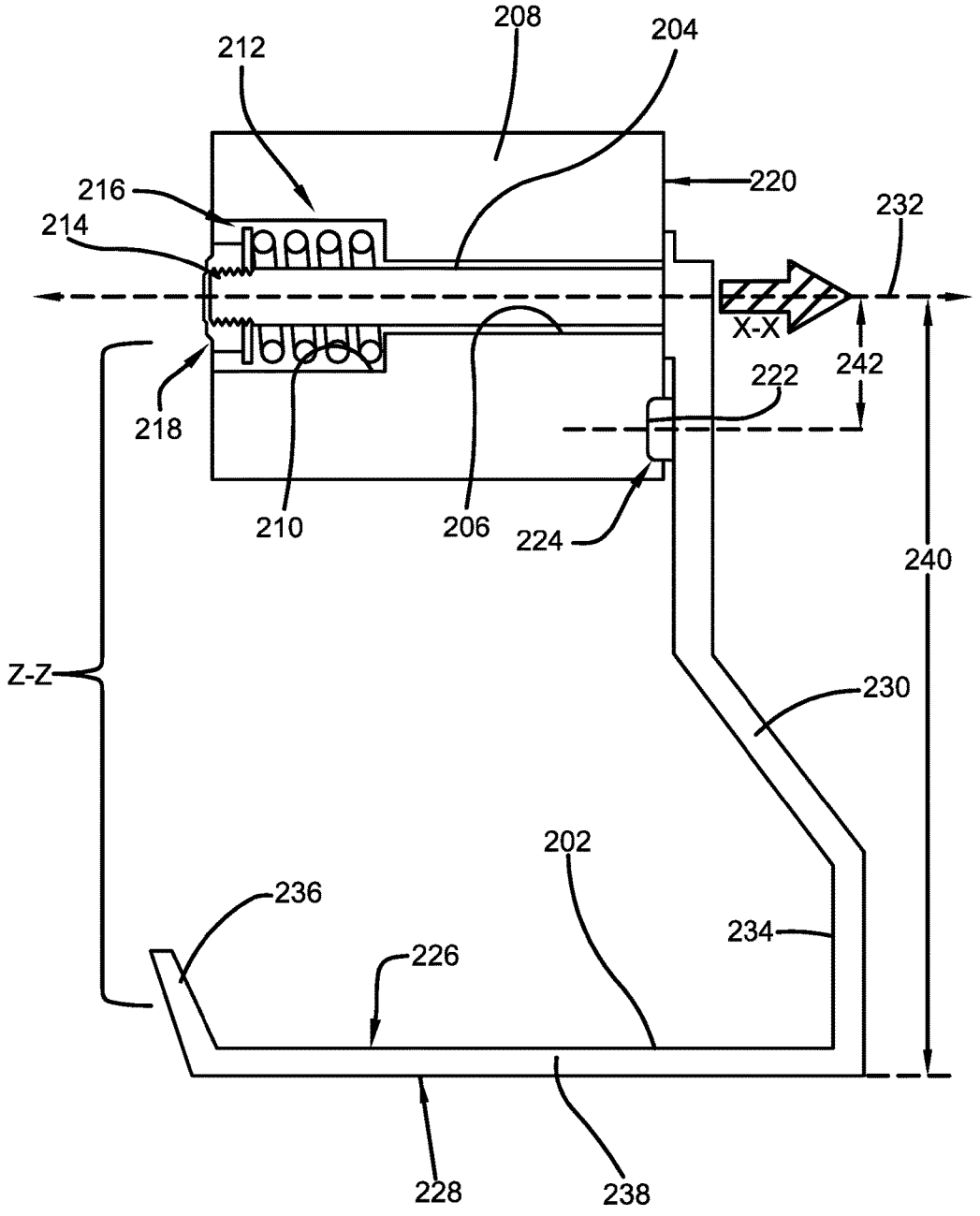
FIG. 2 is a partial top sectional view showing a combination crossbow stirrup and shooting rest mechanism according to some embodiments of this invention.
Figure 3:
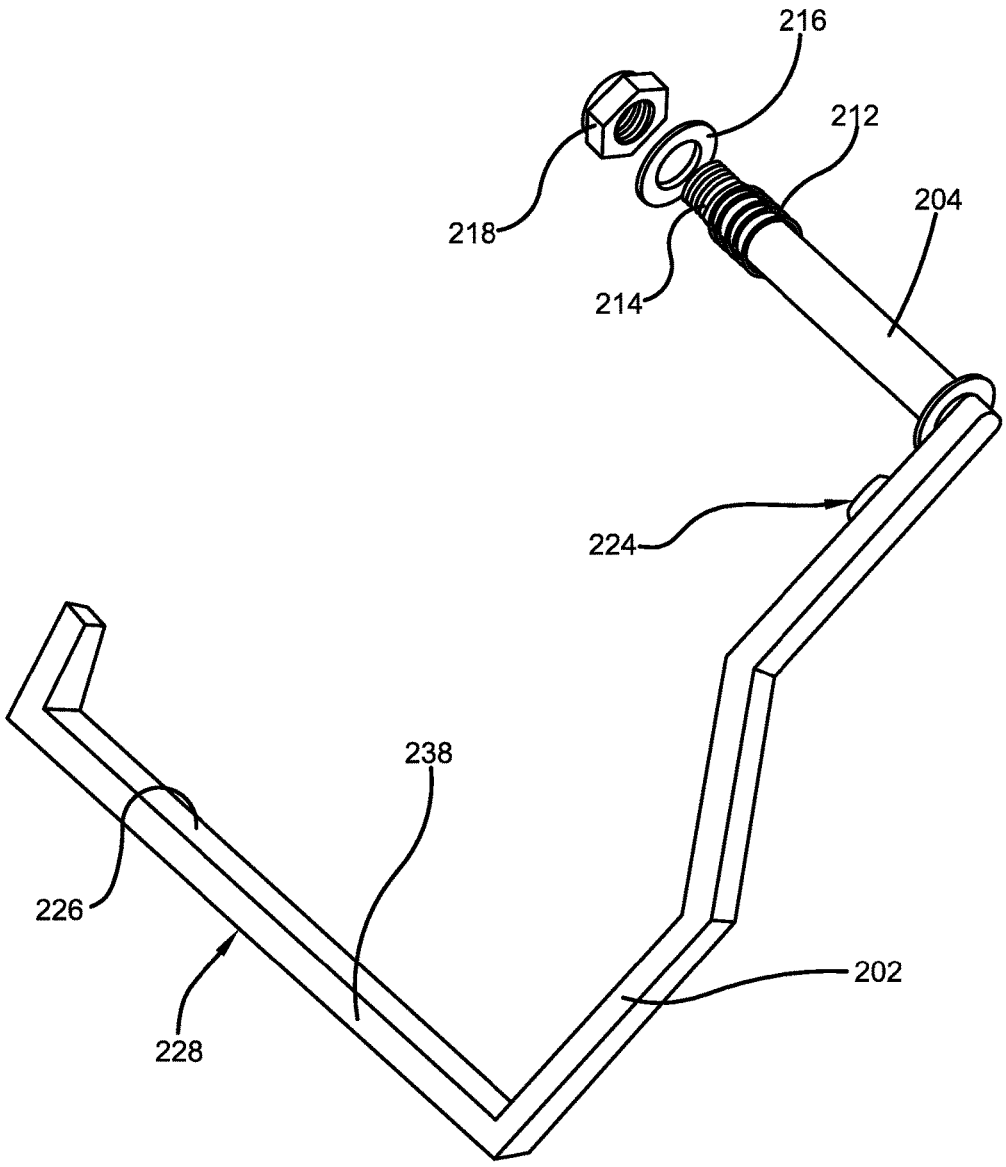
FIG. 3 is a perspective view of a bracket according to some embodiments of this invention.
Figure 4:
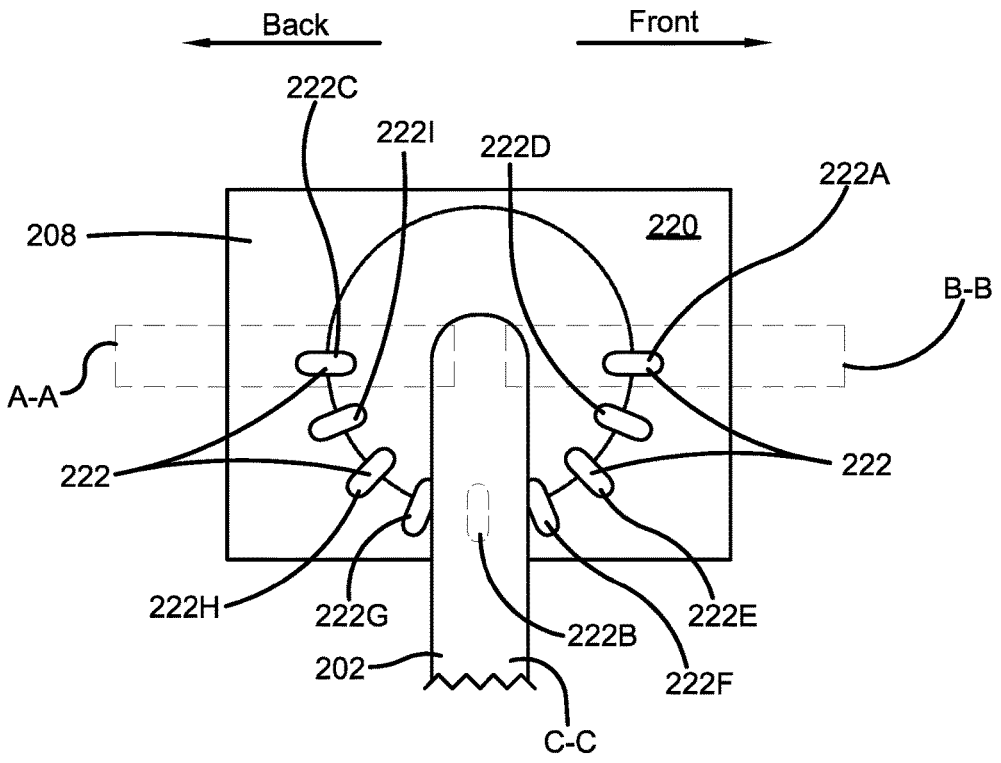
FIG. 4 is a side view showing a portion of a combination crossbow stirrup and shooting rest mechanism and how a bracket may be positioned relative to a bracket engagement device according to some embodiments of this invention.

FIGS. 2-4 show a combination crossbow stirrup and shooting rest mechanism 200 according to some embodiments of this invention. The combination crossbow stirrup and shooting rest mechanism 200 may include a bracket 202 and a bracket engagement device 208. The bracket 202 may be rotatable with respect to the bracket engagement device 208 and may have a connection surface 224 and a pair of distinct contact surfaces 226, 228 that will be discussed further below. The bracket 202 may have any shape and size chosen with the sound judgment of a person of skill in the art. The bracket shown in FIGS. 2-3 has a contact member 238 with the contact surfaces 226, 228 on opposite sides thereof, an axle or pin 204, and a leg 230 that interconnects the axle 204 to the contact member 238 and thus to contact surface 228. In an alternate embodiment, not shown, the axle or pin 204 may be part of the bracket engagement device 208 instead of part of the bracket 202. The axle 204 may define an axis of rotation 232 about which the bracket 202 is rotatable with respect to the bracket engagement device 208. The contact surface 228 may extend generally parallel to the axis of rotation 232, as shown. The leg 230 may have any shape chosen with the sound judgment of a person of skill in the art. For the embodiment shown, the leg extends generally perpendicular to the axis of rotation 232 but has an outwardly extending portion 234 that increases the areas of the contact surfaces 226, 228. Contact surface 226 may be used to receive the foot of a user when the bracket 202 is used as a stirrup while contact surface 228 may be used to contact a ground or other cocking support surface to cock the bow assembly. A guide lip 236 may be provided to guide the user's foot onto the contact surface 226 when the bracket 202 is used as a stirrup. Contact surface 228 may be used to contact a ground or other shooting support surface when the bracket 202 is used as a shooting rest. The contact surface 228 may be spaced from the axis of rotation 232 a distance 240. Distance 240 can be any distance sufficient to permit the bracket 202 to serve as a stirrup and a shooting rest. In one embodiment, distance 240 is at least 4 inches. In another embodiment, distance 240 is at most 12 inches. In yet another embodiment, distance 240 is between 4 inches and 12 inches, inclusive. In still another embodiment, distance 240 is between 5 inches and 8 inches, inclusive. The connection surface 224 may have a centerline spaced from the axis of rotation 232 a distance 242 that may be in the range of 0.5 inches to 4 inches, inclusive. In another embodiment, distance 242 may be in the range of 1 inch to 2 inches, inclusive.

With reference now to FIGS. 1-2 and 4, the bracket engagement device 208 may be supportable to the crossbow main beam. In one embodiment, the bracket engagement device 208 is directly supported to the main beam. In another embodiment, the bracket engagement device 208 is supported to the main beam via a riser. In yet another embodiment, the riser serves as the bracket engagement device 208. In this case, reference 208 represents a crossbow riser. For embodiments where axle 204 is part of the bracket 202, the bracket engagement device 208 may have an opening 206 that rotatably receives the axle 204. In one embodiment, the opening 206 is parallel to the flight rail plane of the crossbow. The axle 204 may have a threaded end 214 that receives a washer 216 and a nut 212 or other securing device to mount the axle, and in some embodiments the bracket 202 also, to the bracket engagement device 208. The bracket engagement device 208 may have a counter bore 210 for purposes to be explained below.

With reference now to FIGS. 2 and 4, the bracket engagement device 208 may have at least two distinct connection surfaces 222 that selectively interconnect with the connection surface 224 of the bracket 202. When bracket connection surface 224 is interconnected to any of the bracket engagement device connection surfaces 222, the bracket 202 is held in position relative to the bracket engagement device 208 as long as the interconnection is maintained. Thus, each connection surface 222 defines a predetermined relative position between the bracket 202 and the bracket engagement device 208. The connection surfaces 222, 224 may be of any type and size chosen with the sound judgment of a person of skill in the art. In one embodiment, the connection surfaces 222 are convex in shape and the connection surface 224 is concave in shape and receives any one of the convex connection surfaces 222. In another embodiment, shown, the connection surfaces 222 are concave in shape and the connection surface 224 is convex in shape. In this case, the convex connection surface 224 is received in any of the concave connection surfaces 222. The specific number and arrangement of connection surfaces 222 can be any chosen with the sound judgment of a person of skill in the art. The connection surfaces 222 may, for the embodiment shown, be arranged on a side surface 220 of the bracket engagement device 208. For the embodiments shown, nine connection surfaces 222 are provided in an evenly divided radial pattern providing a total range of motion of 180 degrees from position A-A to position B-B, as shown in FIG. 4. This provides a range of motion of 22.5 degrees between neighboring connection surfaces, 45 degrees between two connection surfaces having just one connection surface between them (such as 222A and 222E shown in FIG. 4), 90 degrees between position A-A and C-C, 90 degrees between position B-B and C-C, and other ranges of motion as readily understood by a person of skill in the art.

With reference now to FIGS. 2-4, the combination crossbow stirrup and shooting rest mechanism 200 may include one or more biasing force generators 212 that exert a biasing force to bias the bracket 202 into the position defined by one or more of the bracket engagement device connection surfaces 222. The biasing force generator(s) 212 may therefore provide a positive lock for specific relative bracket/bracket engagement device positions. The biasing force generator(s) used can be of any type and size chosen with the sound judgement of a person of skill in the art. In one embodiment, the biasing force generator 212 is a spring, as shown in FIGS. 2 and 3. The spring 212 may be positioned within the counter bore 210 and around the axle 204, as shown. In another embodiment, discussed further below, the one or more biasing force generators 212 may comprise a spring force inherent to the bracket. The one or more biasing force generators 212 may apply a biasing force automatically. By "automatically" it is meant that the biasing force is applied naturally as a characteristic of the biasing force generator without human or other intervention. Spring 212, for example, may be a compression spring that, as is well known to those of skill in the art, automatically applies a force resisting compression of the spring. As a result, the spring 212 placed within the counter bore 210 and beside washer 216 will provide a biasing force that biases the bracket connection surface 224 (and thus the bracket 202) into relative position with respect to a bracket engagement device connection surface 222 (and thus with respect to the bracket engagement device 208).

With reference now to FIGS. 1-4, in operation the user can manually position the bracket 202 into any one of the predetermined positions relative to the bracket engagement device 208 by first pulling the bracket 202 away from the bracket engagement device 208 in direction X-X, shown in FIG. 2. This motion will compress the spring 212, overcoming the spring's biasing force that biases the bracket into the initial relative position, allowing the bracket connection surface 224 to be moved away from (and thus out of interconnection with) the initial engagement device connection surface 222. The bracket 202 can then be manually rotated about the axis of rotation 232 to the desired relative position. Finally, by then manually releasing the bracket 202, the spring biasing force will automatically draw the bracket 202 toward the bracket engagement device 208 and interconnect the bracket connection surface 224 to the juxtaposed engagement device connection surface 222. This biasing force positively locks the bracket 202 in position with respect to the bracket engagement device 208. This process can be repeated as often as desired and the bracket 202 can be positioned relative to the bracket engagement device 208 into any of the positions provided by the engagement device connection surfaces 222.

Still referring to FIGS. 1-4, assuming, for example, that the orientation shown in FIG. 4 is the same as that shown in FIG. 1 (that is, the front and back directions are the same), to adjust the bracket 202 into a suitable position for use as a stirrup, the user may rotate the bracket 202 into relative position B-B shown in FIG. 4. In this cocking position, bracket connection surface 224 interconnects with engagement device connection surface 222A enabling the user to use the bracket 202 as a stirrup to cock the crossbow bow assembly with contact surface 226 receiving the user's foot and contact surface 228 contacting a ground or other cocking support surface. To adjust the bracket 202 into a suitable position for use as a shooting rest, the user may rotate the bracket 202 into relative position C-C shown in FIG. 4. In this shooting rest position, bracket connection surface 224 interconnects with engagement device connection surface 222B enabling the user to use the bracket 202 as a shooting rest with contact surface 228 contacting a ground or other shooting support surface while the user carefully aims and fires the crossbow. To make the crossbow easier to carry, reducing bracket interference with obstacles, the user may adjust the bracket 202 into a suitable position for carrying the crossbow such as by rotating the bracket 202 into relative position A-A shown in FIG. 4. In this carry position, bracket connection surface 224 interconnects with engagement device connection surface 222C and the bracket 202 is "out of the way" of interference as it does not extend significantly frontward or downward.

With continuing reference to FIGS. 1-4, it should be understood that the specific cocking, shooting rest and carry positions just described are exemplary only. In other embodiments, bracket connection surface 224 may interconnect with engagement device connection surface 222D to enable the user to use the bracket 202 as a stirrup. In other embodiments, bracket connection surface 224 may interconnect with engagement device connection surface 222E, 222F, 222G and/or 222H to enable the user to use the bracket 202 as a shooting rest. In still other embodiments, bracket connection surface 224 may interconnect with engagement device connection surface 2221 to enable the user to position the bracket 202 for carrying the crossbow. In some embodiments, the bracket 202 rotates at least 70 degrees with respect to the bracket engagement device 208 about the axis of rotation 232 between the cocking position and the shooting rest position. In other embodiments, the bracket 202 rotates at least 70 degrees with respect to the bracket engagement device 208 about the axis of rotation 232 between the shooting rest position and the carry position. In yet other embodiments, the bracket 202 rotates at least 140 degrees with respect to the bracket engagement device 208 about the axis of rotation 232 between the cocking position and the carry position.

Figure 5:
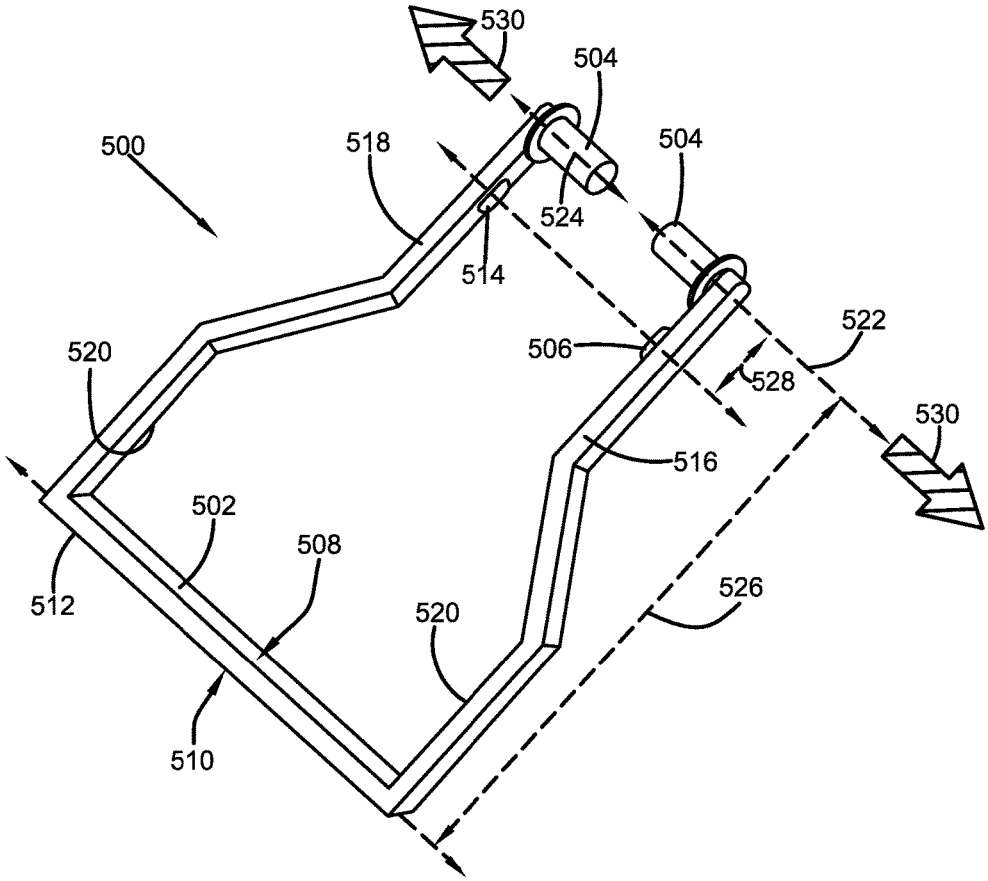
FIG. 5 is a perspective view of a bracket according to some embodiments of this invention.
Figure 6:
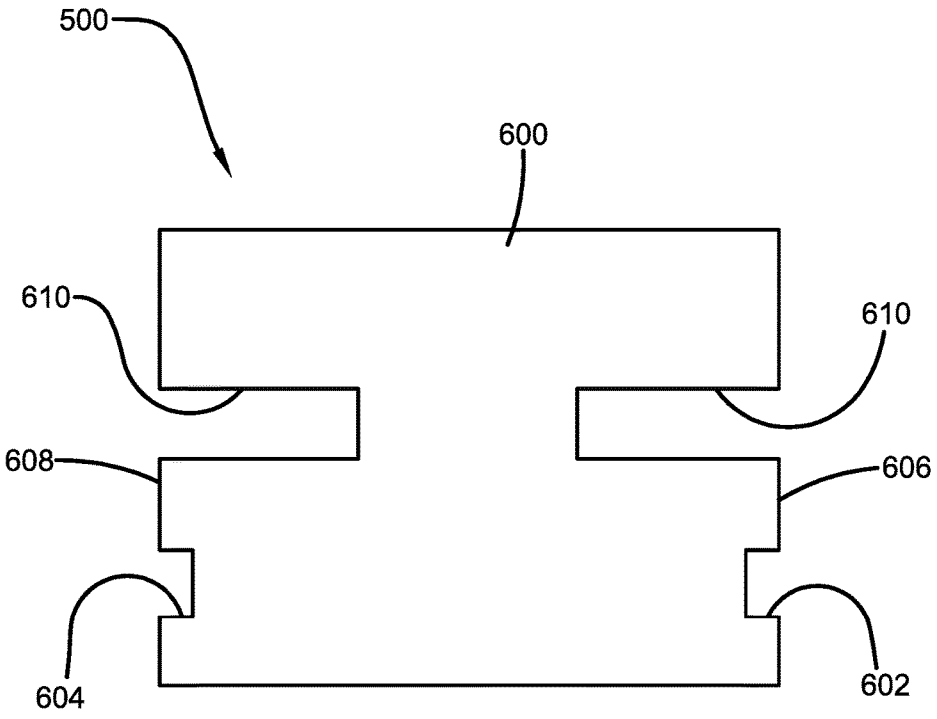
FIG. 6 is a top view of a bracket engagement device that may form, along with the bracket shown in FIG. 5, a combination crossbow stirrup and shooting rest mechanism.

FIGS. 5-6 show a combination crossbow stirrup and shooting rest mechanism 500 incorporating many of the same embodiments disclosed above but also incorporating alternate embodiments from those disclosed above. The alternate embodiments will be especially noted. The combination crossbow stirrup and shooting rest mechanism 500 may include a bracket 502 that may be rotatable with respect to a bracket engagement device 600. The bracket 502 may have a pair of distinct contact surfaces 508, 510 that are positioned on opposite sides of a contact member 512 and used in the same way as previously described contact surfaces 226 and 228. In some embodiments, the bracket 502 has a single connection surface 506 to selectively interconnect with at least two distinct connections surfaces 602 on the bracket engagement device 600. In another embodiment, shown, the bracket 502 has a pair of connection surfaces 506, 514 on opposite legs 516, 518 that selectively interconnect with at least two distinct connections surfaces 602, 604 on each of the opposite sides 606, 608 of the bracket engagement device 600. The bracket 502 may have any shape and size chosen with the sound judgment of a person of skill in the art and may include one or more (two shown) outwardly extending portions 520 that provide the advantages described above regarding outwardly extending portion 234. Previously described bracket 202 can be thought of as an "open" design because there is an open space between the bracket and the axle as indicated with brace Z-Z in FIG. 2. Bracket 502, however, has no such open space and thus can be thought of as a "closed" design.

With continuing reference to FIGS. 5-6, the bracket 502 may have a pair of axles or pins 504, 504 rotatably received in openings 610, 610 formed on the opposite sides 606, 608 of the bracket engagement device 600. In another embodiment, not shown, the axles 504, 504 may be part of the bracket engagement device 600 instead of the bracket 502.

The axles 504, 504 may each define an axis of rotation 522, 524 about which the bracket 502 is rotatable with respect to the bracket engagement device 600. For the embodiment shown, the axes of rotation are collinear. The connection surfaces 602, 604 may be arranged as the connection surfaces 222 described above and shown in FIG. 4. The connection surfaces 506, 514, 602, 604 may be convex and concave in alternative embodiments as with the connection surfaces 222, 224 described above. The contact surface 510 may be spaced from the axes of rotation 522 and/or 524 a distance 526. Distance 526 can be any distance sufficient to permit the bracket 502 to serve as a stirrup and a shooting rest and may have the same range as previously described distance 240. The connection surfaces 506, 514 may, have centerlines that are collinear in some embodiments and non-collinear in other embodiments. These centerlines may be spaced from the axes of rotation 522 and/or 524 a distance 528 that may have the same range as previously described distance 224. If the bracket 502 is made of an appropriate material, such as metal, it will have an inherent spring force. This inherent spring force will maintain the axles 504, 504 within the openings 610, 610. To overcome this spring force to adjust the bracket 502 into a different relative position with respect to the bracket engagement device 600, such as by relative rotation, the user can apply a manual force on both sides as indicated with the arrows 530 in FIG. 5. Once the desired relative position has been achieved, the user may simply release the bracket 502 and the inherent spring force will interconnect the connection surfaces 506, 514 to the desired corresponding connection surfaces 602, 604. As a result, the bracket 502 does not require one or more separate springs as described with other embodiments above. Use and adjustment of the bracket 502 may be similar to bracket 202 described above except for the inherent spring force instead of a separate spring.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved.

In the patent claims that follow, it should be understood that any component referred to as being "associated" is not being claimed positively but rather indicates the environment in which the claimed invention is used. Thus, for a non-limiting example, if a patent claim includes a "combination crossbow stirrup and shooting rest mechanism for use with an associated crossbow" then Applicant's intent is that infringement does not require a crossbow. Rather, infringement only requires a combination crossbow stirrup and shooting rest mechanism that is capable of being used with a crossbow.

Having thus described the invention, it is now claimed:

1. A combination crossbow stirrup and shooting rest mechanism for use with an associated crossbow having a main beam and a bow assembly supported to the main beam; the combination crossbow stirrup and shooting rest mechanism comprising:

a bracket having connection surface and first and second contact surfaces;

a bracket engagement device that is supportable to the main beam and that comprises first and second distinct connection surfaces; and one or more biasing force generators;

wherein when the bracket engagement device is supported to the associated crossbow:

A) the bracket is rotatable with respect to the bracket engagement device between: 1) a cocking position where the connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface connecting a ground or other cocking support surface; and 2) a shooting rest position where the connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface; and B) the one or more biasing force generators exert: 1) a biasing force to bias the bracket into the cocking position and; 2) biasing force to bias the bracket into the shooting rest position; and wherein:

the bracket comprises a first axle and a first leg that interconnects the first axle to the second contact surface;

the first axle defines a first axis of rotation about which the bracket is rotatable with respect to the bracket engagement device;

the bracket engagement device comprises a first opening that rotatably receives the first axle; and the second contact surface is spaced from the first axis of rotation between 5 inches and 8 inches, inclusive.

2. The combination crossbow stirrup and shooting rest mechanism of claim 1 wherein:

the bracket engagement device comprises a third distinct connection surface;

when the bracket engagement device is supported to the associated crossbow: the bracket is rotatable with respect to the bracket engagement device into a carry position where the connection surface of the bracket is interconnected with the third connection surface of the bracket engagement device and the bracket is positioned to enable a user to carry the associated crossbow with reduced bracket interference; and the one or more biasing force generators exert a biasing force to bias the bracket into the carry position.

3. The combination crossbow stirrup and shooting rest mechanism of claim 1 wherein:

the first leg interconnects the first axle to a first end of a contact member comprising the second contact surface;

the bracket comprises a second axle and a second leg that interconnects the second axle to a second end of the contact member opposite the first end;

the second axle defines a second axis of rotation that is collinear with the first axis of rotation and about which the bracket is rotatable with respect to the bracket engagement device; and the bracket engagement device comprises a second opening that rotatably receives the second axle.

4. The combination crossbow stirrup and shooting rest mechanism of claim 1 wherein:

the connection surface of the bracket comprises one of a convex and a concave surface; and each of the first and second connection surfaces of the bracket engagement device comprise the other of a convex and a concave surface.

5. The combination crossbow stirrup and shooting rest mechanism of claim 1 wherein the one or more biasing force generators comprise one of:

a single spring; and a spring force inherent to the bracket.

6. A combination crossbow stirrup and shooting rest mechanism for use with an associated crossbow having a main beam and a bow assembly supported to the main beam; the combination crossbow stirrup and shooting rest mechanism comprising:

a bracket having a connection surface and first and second contact surfaces;

a bracket engagement device that is supportable to the main beam and that comprises first and second distinct connection surfaces; and one or more biasing force generators;

wherein when the bracket engagement device is supported to the associated crossbow:

A) the bracket is rotatable with respect to the bracket engagement device between: 1) a cocking position where the connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; and 2) a shooting rest position where the connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface; and B) the one or more biasing force generators exert: 1) a biasing force to bias the bracket into the cocking position and; 2) a biasing force to bias the bracket into the shooting rest position; and wherein:

the bracket comprises an integral axle and a leg that interconnects the first axle to the second contact surface;

the axle defines an axis of rotation about which the bracket is rotatable with respect to the bracket engagement device; and the bracket engagement device comprises an opening that rotatably receives the first axle.

7. The combination crossbow stirrup and shooting rest of claim 6 wherein:

the bracket engagement device comprises a third distinct connection surface;

when the bracket engagement device is supported to the associated crossbow: the bracket is rotatable with respect to the bracket engagement device into a carry position where the connection surface of the bracket is interconnected with the third connection surface of the bracket engagement device and the bracket is positioned to enable a user to carry the associated crossbow with reduced bracket interference; and the one or more biasing force generators exert a biasing force to bias the bracket into the carry position.

8. The combination crossbow stirrup and shooting rest mechanism of claim 6 wherein:

the connection surface of the bracket comprises one of a convex and a concave surface; and each of the first and second connection surfaces of the bracket engagement device comprise the other of a convex and a concave surface.

9. The combination crossbow stirrup and shooting rest mechanism of claim 6 wherein:

the one or more biasing force generators comprise a single spring.

10. The combination crossbow stirrup and shooting rest mechanism of claim 6 wherein:

the one or more biasing force generators comprise a spring force inherent to the bracket.

11. A combination crossbow stirrup and shooting rest mechanism for use with an associated crossbow having a main beam and a bow assembly supported to the main beam; the combination crossbow stirrup and shooting rest mechanism comprising:

a bracket having a connection surface and first and second contact surfaces;

a bracket engagement device that is supportable to the main beam and that comprises first and second distinct connection surfaces; and one or more biasing force generators;

wherein when the bracket engagement device is supported to the associated crossbow:

A) the bracket is rotatable with respect to the bracket engagement device between: 1) a cocking position where the connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; and 2) a shooting rest position where the connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface; and B) the one or more biasing force generators exert: 1) a biasing force to bias the bracket into the cocking position and; 2) a biasing force to bias the bracket into the shooting rest position; and wherein the one or more biasing force generators comprise one of:

a single spring; and a spring force inherent to the bracket.

12. The combination crossbow stirrup and shooting rest of claim 11 wherein:

the one or more biasing force generators comprise a single spring.

13. The combination crossbow stirrup and shooting rest of claim 11 wherein:

the one or more biasing force generators comprise a spring force inherent to the bracket.

14. The combination crossbow stirrup and shooting rest of claim 11 wherein:

the bracket engagement device comprises a third distinct connection surface;

when the bracket engagement device is supported to the associated crossbow: the bracket is rotatable with respect to the bracket engagement device into a carry position where the connection surface of the bracket is interconnected with the third connection surface of the bracket engagement device and the bracket is positioned to enable a user to carry the associated crossbow with reduced bracket interference; and the one or more biasing force generators exert a biasing force to bias the bracket into the carry position.

15. The combination crossbow stirrup and shooting rest mechanism of claim 11 wherein:

the connection surface of the bracket comprises one of a convex and a concave surface; and each of the first and second connection surfaces of the bracket engagement device comprise the other of a convex and a concave surface.

16. A combination crossbow stirrup and shooting rest mechanism for use with an associated crossbow having a main beam and a bow assembly supported to the main beam; the combination crossbow stirrup and shooting rest mechanism comprising:

a bracket having a first connection surface and first and second contact surfaces;

a bracket engagement device that is supportable to the main beam and that comprises first and second distinct connection surfaces; and one or more biasing force generators;

wherein when the bracket engagement device is supported to the associated crossbow:

A) the bracket is rotatable with respect to the bracket engagement device between: 1) a cocking position where the first connection surface of the bracket is interconnected with the first connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; and 2) a shooting rest position where the first connection surface of the bracket is interconnected with the second connection surface of the bracket engagement device and the bracket is positioned to enable a user to use the combination crossbow stirrup and shooting rest mechanism as a shooting rest to shoot the associated crossbow with the second contact surface contacting a ground or other shooting support surface; and B) the one or more biasing force generators exert: 1) a biasing force to bias the bracket into the cocking position and; 2) a biasing force to bias the bracket into the shooting rest position; and wherein:

the bracket comprises a first axle and a first leg that interconnects the first axle to a first end of a contact member comprising the second contact surface;

the first axle defines a first axis of rotation about which the bracket is rotatable with respect to the bracket engagement device;

the bracket engagement device comprises a first opening that rotatably receives the first axle;

the bracket comprises a second axle and a second leg that interconnects the second axle to a second end of the contact member opposite the first end;

the second axle defines a second axis of rotation that is collinear with the first axis of rotation and about which the bracket is rotatable with respect to the bracket engagement device; and the bracket engagement device comprises a second opening that rotatably receives the second axle.

17. The combination crossbow stirrup and shooting rest of claim 16 wherein:

the first connection surface of the bracket is positioned on the first leg;

the bracket has a second connection surface positioned on the second leg;

the first and second distinct connection surfaces of the bracket engagement device are positioned on a first side of the bracket engagement device;

third and fourth distinct connection surfaces of the bracket engagement device are positioned on a second side of the bracket engagement device opposite the first side;

the bracket is rotatable with respect to the bracket engagement device between: 1) the cocking position where the second connection surface of the bracket is interconnected with the third connection surface of the bracket engagement device and the bracket is positioned to enable a user to use the combination crossbow stirrup and shooting rest mechanism as a stirrup to cock the associated bow assembly with the first contact surface receiving the user's foot and the second contact surface contacting a ground or other cocking support surface; and 2) the shooting rest position where the second connection surface of the bracket is interconnected with the fourth connection surface of the bracket engagement device and the bracket is positioned to enable a user to use the combination crossbow stirrup and shooting rest mechanism as a shooting rest to shoot the associated crossbow with the second contact surface contacting a ground or other shooting support surface.

18. The combination crossbow stirrup and shooting rest of claim 16 wherein:

the one or more biasing force generators comprise a spring force inherent to the bracket.

19. The combination crossbow stirrup and shooting rest of claim 16 wherein:

the bracket engagement device comprises a third distinct connection surface;

when the bracket engagement device is supported to the associated crossbow: the bracket is rotatable with respect to the bracket engagement device into a carry position where the connection surface of the bracket is interconnected with the third connection surface of the bracket engagement device and the bracket is positioned to enable a user to carry the associated crossbow with reduced bracket interference; and the one or more biasing force generators exert a biasing force to bias the bracket into the carry position.

20. The combination crossbow stirrup and shooting rest mechanism of claim 16 wherein:

the first connection surface of the bracket comprises one of a convex and a concave surface; and each of the first and second connection surfaces of the bracket engagement device comprise the other of a convex and a concave surface.

* * * * *